United States Patent [19]

Davis

[11] 4,193,702

[45] Mar. 18, 1980

[54] JET MIXER AND METHOD

[76] Inventor: Philip E. Davis, 5451 Appleblossom, Friendswood, Tex. 77546

[21] Appl. No.: 944,007

[22] Filed: Sep. 20, 1978

[51] Int. Cl.[2] ..... B01F 13/00; B01F 5/12; B01F 7/00

[52] U.S. Cl. ..... 366/343; 366/265; 366/317

[58] Field of Search ..... 366/317, 315, 265, 282, 366/155, 168, 169, 176, 325, 262, 263, 261, 264, 343, 342

[56] References Cited

U.S. PATENT DOCUMENTS

| | | | |
|---|---|---|---|
| 2,592,904 | 4/1952 | Jackson | 366/169 X |
| 2,816,744 | 12/1957 | Penther | 366/265 X |
| 2,869,841 | 1/1959 | Cowan | 366/265 |
| 3,595,547 | 7/1971 | Polomsky | 366/262 |

FOREIGN PATENT DOCUMENTS

| | | | |
|---|---|---|---|
| 1192796 | 5/1970 | United Kingdom | 366/265 |

*Primary Examiner*—Edward J. McCarthy

[57] ABSTRACT

A jet impeller mixer-agitator having a shaft adapted for rotation by a power source, a hub communicating with the shaft and at least one hollow blade fixed to the hub, the hollow blade having a fluid entrance opening on the effective face of the blade and a fluid exit opening on the non-effective face of the blade with a fluid passage connecting the fluid entrance opening and the fluid exit opening so that upon rotation of the shaft the fluid is directly forced into the fluid entrance opening, through the fluid passage and out of the fluid exit opening.

19 Claims, 9 Drawing Figures

FIG. 3
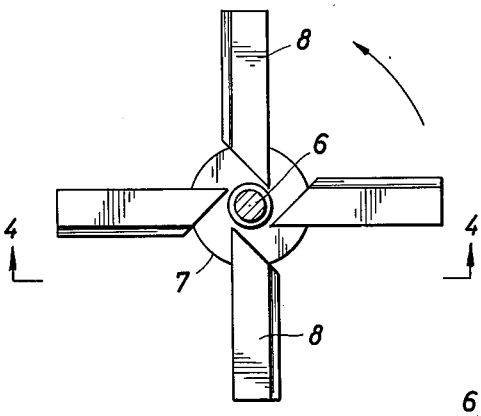
FIG. 5
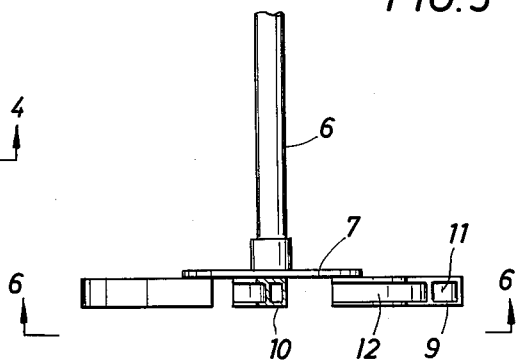
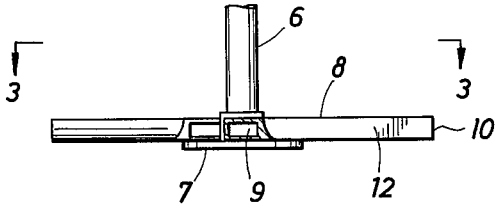
FIG. 4
FIG. 6
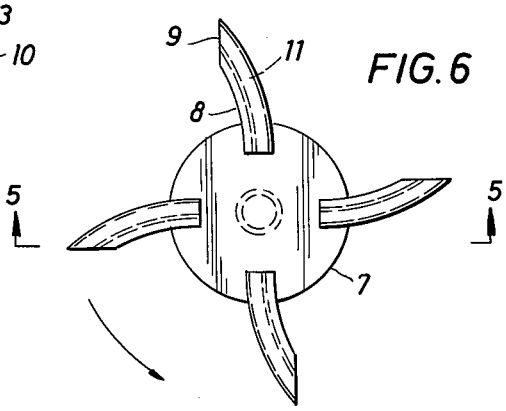
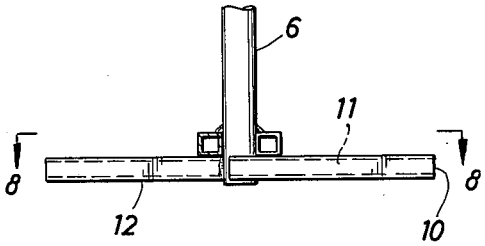
FIG. 7
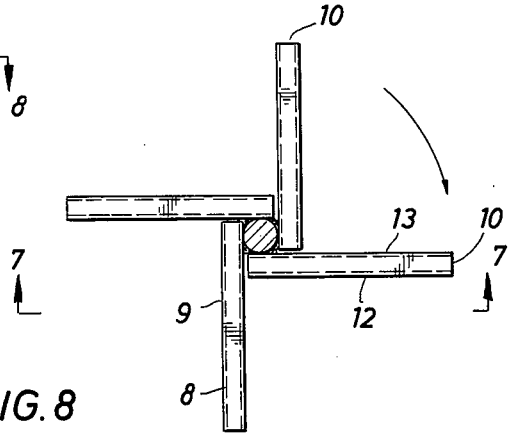
FIG. 8

JET MIXER AND METHOD

BACKGROUND OF THE INVENTION

This invention relates to an improved mixing or agitating device, particularly to an apparatus for mixing viscous fluids and more particularly to an impeller having tubular blades which through the motion of its blades forces fluid into one part of the blades and out another part of the blades. This impeller is capable of not only imparting movement of fluid perpendicular to the length of the blade but simultaneously imparting superior movement of the fluid parallel to the length of the blade.

Many types of paddles, propellers, turbines and radial impellers and the like have been used to mix fluids. The fundamental problems of mixing and agitating of fluids are associated with the types of motion that can be imparted to the fluid. Mixing is the result of material transfer through momentum transfer and turbulence. Mixing requires moving the fluid, and is best accomplished by moving high velocity streams adjacent to low velocity streams creating flow velocity discontinuities. Whenever one fluid stream moves at high velocity compared to another stream, turbulence and agitation are produced, entraining adjacent fluid thereby producing the maximum mixing.

It is the shape of the impeller that determines the initial flow path, velocity and quantity of flow. The initial flow path depends on the type of impeller, such as marine-type propeller, turbine or flat paddle. The marine type propeller can produce essentially axial flow, i.e. flow that leaves the impeller in the direction of the axis of rotation or parallel with the shaft (the total flow path is determined not only by the impeller but by the shape of the container, the baffles or obstructions and the angle and place at which the shaft enters the fluid relative to the container). Flat paddles and turbines can produce essentially radial flow, i.e. flow that is initially parallel to the length of the impeller; perpendicular to the axis of rotation or shaft.

One of the most effective mixers for relative non-viscous fluids is described in U.S. Pat. No. 2,816,744 which was issued Dec. 17, 1957. The mixer of the above patent consists of a hollow tube with an entrance at its bottom with tubular blades attached to the hub. The tubular blades open into the hollow of the hub at one end and are open at the other end. The rotation of the impeller draws the fluid into the chamber of the hollow tube and jets it out the end of the blade thereby getting very good radial flow. In addition, the external portion of the blade is flattened at an inclination relative to the axis of rotation so that it acts as a screw type impeller imparting motion to the fluid essentially parallel to the axis of rotation.

There are many viscous fluids, such as drilling fluids, concrete, petroleum crudes, aqueous oleaginous emulsions and the like which are particularly hard to mix. Some of these fluids are prepared by blending liquids and dry granular ingredients, liquids and gases, or two or more substantially immiscible liquids. Many of the fluids tend to separate into layers, or to form thixotrophic gels. The mixing of viscous fluids such as dry and liquid materials, gels, thixotrophic gels and layered fluids is a difficult problem. The present invention is a mixer-agitator with an impeller which is able to mix viscous fluids of the above description, giving maximum radial or lateral flow, i.e. perpendicular to the axis of rotation. The impeller of this invention directly forces fluid into and through the tubular blades thereby achieving optimum lateral jetting action.

SUMMARY OF THE INVENTION

The present invention relates to a mixer-agitator for mixing and stirring fluids, especially viscous fluids. The invention relates to a mixer-agitator with an impeller capable of imparting maximum lateral flow to a fluid. It further relates to a mixer-agitator having an impeller with hollow or tubular radial blades with the fluid entrance opening of the leading edge or effective face of the blade so that rotation of the impeller forces fluid directly into the tubular blade, through the blade and out a second fluid exit opening on the non-leading edge or non-effective face of the blade. This invention further relates to a mixer-agitator with an impeller having tubular blades for force jetting fluids where the face of the blade is shaped into a channel to impart lateral motion to the fluid which contracts the blade face. It relates to an impeller having tubular blades for force jetting fluids where the face of the blades is slanted relative to the axis of rotation to form a screw type impeller for simultaneously imparting axial and radial motion to the fluid.

BRIEF DESCRIPTION OF THE DRAWING

FIG. 3 is a section view of the mixer-agitator taken on the line 3—3 of FIG. 4.

FIG. 4 is a section view of the mixer-agitator taken on the line 4—4 of FIG. 3; and FIG. 5 is a sectional view of the mixer of FIG. 6 taken along the line 5—5.

FIG. 6 is a view of the mixer-agitator of FIG. 5 from the bottom.

FIG. 7 is a view of the mixer of FIG. 8 taken perpendicular to the axis of rotation.

FIG. 8 is a sectional view of the mixer-agitator of FIG. 7 along the line 8—8.

DESCRIPTION OF THE PREFERRED EMBODIMENTS

The invention will be described further with reference to the drawings for details.

Figure 1:
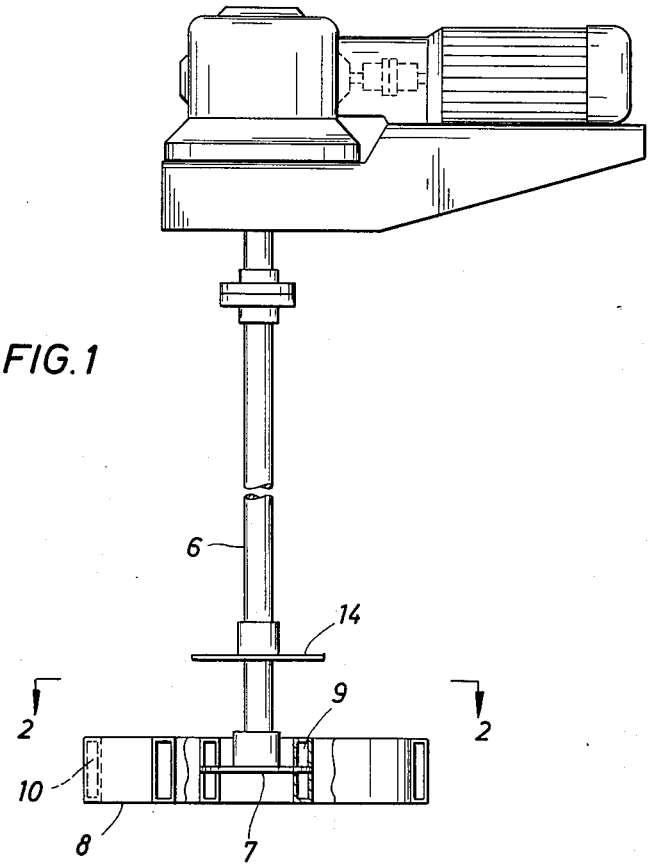
FIG. 1 is a section view taken on the section line 1—1 of FIG. 2 and showing the impeller mixer-agitator.

The direct flow jet impeller mixer is shown in FIG. 1 consisting of a supporting shaft 6 adapted to be connected to a source of power for rotation. The power source may be any type, either direct or indirect drive, either slow, high, or variable speed rotation.

Attached to or communicating with the shaft 6 is a hub 7. The hub 7 can be an integral part of the shaft 6 as in FIGS. 5 and 6 or a simple extension of the shaft as in FIGS. 7 and 8 or fixed to the shaft via welding, screws, rivets or any attachment means as in FIGS. 1–4. The hub 7 can be a designated part of the shaft 6 as in FIGS. 7 and 8, (i.e. that part of the shaft 6 to which the blades are attached) or can extend perpendicularly away from the shaft as in FIGS. 1–6. The preferred hub 7 is a simple solid disk with a collar attached to the shaft extending perpendicularly from the shaft as in FIGS. 1 and 2.

A line down the longitudinal center of the shaft 6 and hub 7 forms the axis of rotation.

Connected to the hub 7 is at least one tubular blade 8. The preferred number of blades is between about 2 and about 8, most preferably, between about 4 and about 6. Each tubular blade 8 has at least one fluid entrance opening 9 and at least one fluid exit opening or outlet 10. The entrance opening 9 and the exit opening 10 are connected by a fluid passage 11. The fluid entrance opening 9 is positioned on the blade such that it faces in the direction of rotation so that as the blade rotates fluid is forced into the fluid entrance opening 9, through the fluid passage 11 and out of the fluid exit opening 10.

It is preferable that the plane made by the hub 7 be perpendicular to the shaft 6 and the axis of rotation. Furthermore, it is preferred that the blade or blades 8 be essentially in a plane perpendicular to shaft 6 and the axis of rotation.

The blade or blades 8 are attached to the hub 7 (by welding, screws, rivets or any means or formed as part of the hub), and extend substantially radially from the axis of rotation or shaft 6. In one embodiment of the invention, the blades 8 are attached to hub 7 so that a line through the center of the blade 8, perpendicular to the axis of rotation, at the end of the blade 8 closest to the shaft 6, would travel through the axis of rotation, as in FIG. 3. When the blades 8 are straight they form the radius of a circle with the center of the shaft 6 as the center of the circle. In a preferred embodiment of the invention, the blade or blades 8 are attached to the hub 7 at an angle so that a line tangent to the center of the blade 8, perpendicular to the shaft 6, would not go through the axis of rotation but would intersect a plane parallel and through the axis of rotation at an angle as in FIGS. 2 and 8, i.e. a line tangent to the center of the blade, along its length, at the end closest to the axis of rotation, would form a cord of a circle formed by the end of the blade furthest from the axis of rotation when rotated. The preferred orientation is one where the end of the blade 8 closest to the hub 7 leads or is more advanced in the direction of rotation than the end of the blade 8 furthest from the hub 7. This off-center embodiment is preferred because it makes the maximum use of the available power source and because it correctly positions the fluid entrance 9, when at the end of the blade 8 to achieve maximum fluid forced into the entrance 9. It is also the only orientation which will force the fluid into the fluid entrance 9 when the only fluid entrance 9 on a blade 8 is at the end of the blade nearest the shaft 6.

The fluid entrance 9 is always positioned so that when the blade is rotated through the fluid, fluid is forced into the fluid entrance 9. It requires that the fluid entrance 9 be on or part of the effective face or leading edge 12 of the blade.

When the direction of fluid flow through the fluid passage 11 is to be away from the axis of rotation or shaft 6, the fluid entrance opening 9 is on the blade 8 closer to the shaft 6 than the fluid exit opening 10 as in FIGS. 1–4 and 7–8. When the direction of fluid flow through the fluid passage 11 is to be toward the axis of rotation or shaft 6, the entrance opening 9 is further from the axis of rotation, or shaft 6, than the fluid exit opening 10 as in FIGS. 5 and 6. The fluid entrance 9 can be at the end of the blade 8 as it is in FIGS. 1 and 2, or can be the end and part of the face 12 of the blade as it is in FIGS. 3–6 or it can be only on the face 12 of the blade.

The blade 8 can be attached to or communicate with the hub 7 so that the fluid entrance is partly above and partly below the hub 7 or the plane made by the hub 7 perpendicular to the axis of rotation as in FIG. 1. In another embodiment the fluid entrance 9 can be placed so that all of the opening is above the plane made by the hub 7 as it is in FIGS. 3 and 4 or it can be placed so that all of the opening is below the plane made by the hub 7 as it is in FIGS. 5 and 6. The preferred embodiment is to have one fluid entrance 9 and one fluid exit 10 per blade.

The position of the fluid axis 10 on the blade 8 determines the direction in which the fluid is jetted into the systems. The fluid exit opening 10 can be on any portion of the blade facing in a non-direction of rotation. The fluid exit 10 can open at the very end of the blade so as to jet the fluid toward or away from the axis of rotation; it may open on the top or the bottom of the blade so as to jet the fluid essentially parallel to the axis of rotation; or it may open on the back of the blade 13 so as to jet the fluid parallel to the plane made by the blades 8 on rotation. It is possible to have a fluid exit 10 on the blade face 12 when the fluid exit 10 is shrouded so that the opening is not on the effective face. The preferred embodiment has the fluid exit opening 10 at the end of the blade 8 furthest from the shaft so as to achieve maximum fluid movement perpendicular to and away from the axis of rotation.

Figure 2:
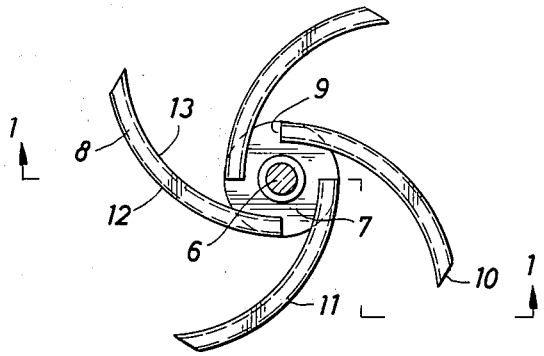
FIG. 2 is a section view of the mixer-agitator taken on the line 2—2 of FIG. 1.

The shape of the blade 8 when viewed parallel to the axis of rotation can be either straight as in FIG. 3 or curved or arc shaped (arcuated) as in FIGS. 2 and 6. When curved, and the entrance 9 is closer to the shaft 6 than the exit 10 it is preferred that the face of the blade 8 when viewed parallel to the axis of rotation is convex relative to the direction of rotation. When curved and the entrance 9 is further from the shaft 6 than the exit 10 it is preferred that the face 12 of the blade 8 when viewed parallel to the axis of rotation is concave relative to the direction of rotation.

Figure 9:
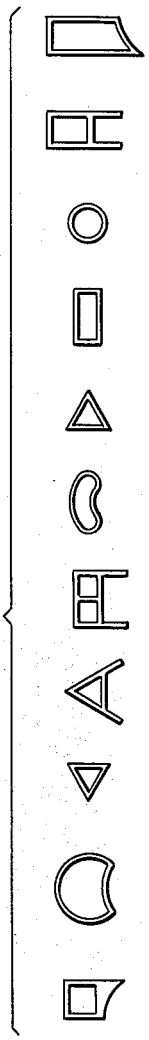
FIG. 9 (1-11) is a series of cross-sections of representative blades.

The cross-sectional shape of the tubular blade 8 can be any shape and illustrative embodiments are shown in FIG. 9. One preferred embodiment is to have the face 12 of the tubular blade 8 form a channel or be concaved so that it traps the fluid on its face and forces it radially (FIGS. 5 and 9–2, 9–6, 9–7 and 9–8). Another preferred embodiment is to have the face 12 of the tubular blade 8 shaped as the conventional marine-type propeller so that when rotated fluid is forced by the face 12 in a direction essentially parallel to the axis of rotation (FIGS. 3, 4, 9–5 and 9—9).

When the invention has more than one blade attached to the same hub 7, these blades can be a combination of tubular blades 8 and conventional blades of any type, for example, two tubular blades and two conventional blades, such as paddle or screw types. The invention can also have two or more tubular blades attached to the same hub with different cross-sectional shapes. In one embodiment of the invention the tubular blades 8 can be attached to or communicate with the hub 7 so some of the blades 8 have fluid entrances 9 on one side of the plane and some of the blades 8 have fluid entrances 9 on the other side of said plane.

Optionally, the invention can be equipped with an anti-cavitation baffle or flow control 14 attached to or communicating with the shaft 6 between the hub 7 and the power source. When the fluid entrance opening 9 is below the plane of the hub 7 and the hub 7 extends out over said fluid entrance opening 9 then the hub 7 acts as an anti-cavitation baffle.

When there is no effective anti-cavitation baffle, then the mixer-agitator can perform usefully as a device for mixing gases with liquids, (i.e. aerate).

I claim as my invention;

1. A jet impeller mixer-agitator adapted for immersion in a body of fluid comprising:

(1) a shaft adapted for rotation by a power source, (2) a hub on said shaft connected for rotation therewith, and (3) at least one tubular blade connected to said hub for rotation therewith, and extending substantially radially from said shaft, said tubular blade having at least one fluid entrance opening facing substantially in the direction of rotation, at least one fluid exit opening facing substantially in a non-direction of rotation, and at least one fluid passage in flow communication with the fluid entrance opening and the fluid exit opening.

2. A jet impeller mixer-agitator adapted for immersion in a body of fluid comprising:

(1) a shaft adapted for rotation by a power source, (2) a hub on said shaft connected for rotation therewith, and (3) at least one tubular blade connected to said hub for rotation therewith, and extending substantially radially from said shaft, each of said tubular blades having at least one fluid entrance opening facing substantially in the direction of rotation, at least one fluid exit opening facing substantially in a non-direction of rotation and at least one fluid passage in flow communication with the fluid entrance opening and the fluid exit opening, one of said openings being closer to the shaft on said blade than the other opening.

3. The jet impeller mixer-agitator of claim 1 or 2 having between 2 and 8 tubular blades.

4. The jet impeller mixer-agitator of claim 3 where the fluid entrance opening is closer to the shaft than the fluid exit opening.

5. The jet impeller mixer-agitator of claim 3 where the fluid entrance opening is further from the shaft than the fluid exit opening.

6. The jet impeller mixer-agitator of claim 4 where the blade is arcuated in a convex manner relative to the direction of rotation.

7. The jet impeller mixer-agitator of claim 5 where the blade is arcuated in a concave manner relative to the direction of rotation.

8. The jet impeller mixer-agitator of claim 6, or 7 where the blade is attached to the hub so that a line tangent to the longitudinal center of the blade at the end of the blade closest to the shaft would form a cord of the circle made by the end of the blade furthest from the shaft when the impeller was rotated.

9. The jet impeller mixer-agitator of claim 3 where the face of the tubular blades have channels for moving the fluid in a direction perpendicular to the axis of rotation.

10. The jet impeller mixer-agitator of claim 3 where the face of the tubular blades are inclined relative to the axis of rotation so that, upon rotation, the face of the blade moves the fluid in a direction substantially parallel to the axis of rotation.

11. A jet impeller mixer-agitator adapted for immersion in a body of fluid comprising:

(1) a shaft adapted for rotation by a power source, (2) a hub on said-shaft connected for rotation therewith, and (3) between 2 and 6 tubular blades connected to said hub for rotation therewith and extending substantially radially from said shaft, said blades being connected to said hub so that a line tangent to the longitudinal center of the blade at the end of the blade closest to the shaft would form a cord of the circle made by the end of the blade furthest from the shaft, the end of the blade nearest the shaft being advanced in the direction of rotation relative to the end of the blade furthest from the shaft, said tubular blade having at least one fluid entrance opening on the effective face of the blade, at least one fluid exit opening on the non-effective face of the blade, said fluid exit opening being further from the shaft than said fluid entrance opening, and at least one fluid passage in flow communication with the fluid entrance opening and the fluid exit opening.

12. A method of mixing and agitating a fluid comprises:

(a) inserting below the surface of the fluid a mixing-/agitating device comprising;

(1) a shaft adapted for rotation by a power source, (2) a hub on said shaft connected for rotation therewith, and (3) at least one tubular blade connected to said hub for rotation therewith, said tubular blade having at least one fluid entrance opening facing substantially in the direction of rotation, at least one fluid exit opening facing substantially in a non-direction of rotation, and at least one fluid passage in flow communication with the fluid entrance opening and the fluid exit opening;

(b) rotating the shaft, so that fluid is forced directly into the fluid entrance opening, through the fluid passage and out the fluid exit opening of the tube.

13. A jet impeller mixer-agitator adapted for immersion in a body of fluid comprising:

(1) a shaft adapted for rotation by a power source, (2) a hub on said shaft connected for rotation therewith, and (3) at least one tubular blade connected to said hub for rotation therewith, and extending substantially radially from said shaft, said tubular blade having at least one fluid entrance opening facing substantially in the direction of rotation, at least one fluid exit opening facing substantially in a non-direction of rotation, at least one fluid passage in flow communication with the fluid entrance opening and the fluid exit opening, where the fluid entrance opening is further from the shaft than the fluid exit opening.

14. The jet impeller mixer-agitator of claim 13 where the blade is arcuated in a concave manner relative to the direction of rotation.

15. A jet impeller mixer-agitator adapted for immersion in a body of fluid comprising:

(1) a shaft adapted for rotation by a power source, (2) a hub on said shaft connected for rotation therewith, and (3) at least one tubular blade connected to said hub for rotation therewith, extending substantially radially from said shaft, said tubular blade having at least one fluid entrance opening facing substantially in the direction of rotation, at least one fluid exit opening facing substantially in a non-direction of rotation and at least one fluid passage in flow communication with the fluid entrance opening and the fluid exit opening where the fluid entrance opening is closer to the shaft than the fluid exit opening and the blade is arcuated in a convex manner relative to the direction of rotation.

16. The jet impeller mixer-agitator of claim 16 or 15 where the blade is attached to the hub so that a line tangent to the longitudinal center of the blade at the end of the blade closest to the shaft would form a cord of the circle made by the end of the blade furtherest from the shaft when the impeller was rotated.

17. A jet impeller mixer-agitator adapted for immersion in a body of fluid comprising:

(1) a shaft adapted for rotation by a power source, (2) a hub on said shaft connected for rotation therewith, and (3) at least one tubular blade connected to said hub for rotation therewith, and extending substantially radially from said shaft, said tubular blade having at least one fluid entrance opening facing substantially in the direction of rotation, at least one fluid exit opening facing substantially in a non-direction of rotation and at least one fluid passage in flow communication with the fluid entrance opening and the fluid exit opening, where the hub extends radially from the shaft and the blade is attached to the hub so that the entrance opening is entirely on that side of the hub facing the power source.

18. A jet impeller mixer-agitator adapted for immersion in a body of fluid comprising:

(1) a shaft adapted for rotation by a power source, (2) a hub on said shaft connected for rotation therewith, and (3) at least one tubular blade connected to said hub for rotation therewith, and extending substantially radially from said shaft, said tubular blade having at least one fluid entrance opening facing substantially in the direction of rotation, at least one fluid exit opening facing substantially in a non-direction of rotation and at least one fluid passage in flow communication with the fluid entrance opening and the fluid exit opening, where the hub extends radially from the shaft and the blade is attached to the hub so that the entrance opening is on that side of the hub facing away from the power source.

19. A jet impeller mixer-agitator adapted for immersion in a body of fluid comprising:

(1) a shaft adapted for rotation by a power source, (2) a hub on said shaft connected for rotation therewith, and (3) at least one tubular blade connected to said hub for rotation therewith, and extending substantially radially from said shaft, said tubular blade having at least one fluid entrance opening facing substantially in the direction of rotation, at least one fluid exit opening facing substantially in a non-direction of rotation and at least one fluid passage in flow communication with the fluid entrance opening and the fluid exit opening, where the hub extends radially from the shaft and the blade is attached to the hub so that one fluid entrance opening is on that side of the hub facing the power source and another fluid entrance opening is on the side of the hub facing away from the power source.

* * * * *